US006414577B1

(12) United States Patent
Hoffman

(10) Patent No.: US 6,414,577 B1
(45) Date of Patent: Jul. 2, 2002

(54) CORE WITH COILS AND PERMANENT MAGNET FOR SWITCHING DC RELAYS, RF MICROWAVE SWITCHES, AND OTHER SWITCHING APPLICATIONS

(76) Inventor: Jerzy Hoffman, P.O. Box 33478, Las Vegas, NV (US) 98133

( * ) Notice: Subject to any disclaimer, the term of this patent is extended or adjusted under 35 U.S.C. 154(b) by 0 days.

(21) Appl. No.: 09/503,580

(22) Filed: Feb. 14, 2000

(51) Int. Cl.[7] ..... H01F 7/00; H01F 7/16; H01F 7/08

(52) U.S. Cl. ..... 335/229; 335/230

(58) Field of Search ..... 335/229–234

(56) References Cited

U.S. PATENT DOCUMENTS 4,306,207 A * 12/1981 Tada et al. ..... 335/234
4,422,060 A * 12/1983 Matsumoto et al. ..... 335/256
4,506,701 A * 3/1985 Masaki et al. ..... 137/596.17
4,550,302 A * 10/1985 Watanabe et al. ..... 335/228
4,782,315 A 11/1988 Bataille et al.
4,795,994 A 1/1989 Hoffman
5,272,458 A 12/1993 Hoffman et al.
5,302,929 A * 4/1994 Kovacs ..... 335/229
5,809,157 A * 9/1998 Grumazescu ..... 381/199

* cited by examiner

*Primary Examiner*—Ramon M. Barrera
(74) *Attorney, Agent, or Firm*—Kevin Redmond

(57) ABSTRACT

A core with coils and permanent magnet, and a movable magnet holder including permanent magnet and contained within a channel defined by a magnet holder housing is provided. By aligning the north and south poles of the two permanent magnets in relation to each other and the poles of the electromagnet formed by the electromagnetic coils and core, motion of the magnet holder both toward and away from the core between a first and second position can be readily induced by applying voltage across the leads of the electromagnetic coils. This motion can be used to move a switching means back and forth between two positions relating to the first and second positions of the magnet holder to perform various failsafe, latching and other useful switching functions.

1 Claim, 4 Drawing Sheets

CORE WITH COILS AND PERMANENT MAGNET FOR SWITCHING DC RELAYS, RF MICROWAVE SWITCHES, AND OTHER SWITCHING APPLICATIONS

BACKGROUND

1. Technical Field of the Invention

This invention relates to switching structures comprising cores with coils and permanent magnets, intended for applications including DC relays, RF microwave switches and other similar switching components and applications.

2. Description of Related Art

While there have been a number of advances in the technology relating to all-electronic switching devices in recent years, there remain many applications for which such devices cannot replace their electromechanical magnetic counterparts. As a consequence, a need continues for highly reliable electromagnetic actuators for switching applications, especially where a switching device is subject to high impact and/or vibration, high acceleration, or widely varying environmental conditions.

Many examples of existing electromagnetic switching devices such as relays, capable of reliable operation under such demanding conditions, exist in the art; however, most are complex and comprise a number of components which are typically expensive and difficult to manufacture.

Reliable operation of these devices often depends upon precision machining and costly alignment, further complicating mass production techniques and adding to manufacturing costs. The Model 412K-Series TO-5 Relay manufactured by the Teledyne Corporation, discussed in the present inventor's U.S. Pat. No. 5,272,458, is an example of existing electromagnetic switching devices described above. The invention of U.S. Pat. No. 5,272,458 obviated the limitations associated with the Model 412K-Series TO-5 Relay and similarly conceived switches and devices by providing a solenoid actuator which is highly reliable, simple to construct, relatively inexpensive to manufacture, and is able to withstand the severe operating and environmental conditions identified herein.

The invention presented in U.S. Pat. No. 5,272,458, while supplying the industry with a highly successful actuator, is not without its limitations. In order to achieve various failsafe, latching and other useful switching functions, it is necessary to change the basic design by altering the ferromagnetic mass which attracts the permanent magnet of the slider to its second position, or by reversing the current flow of the electromagnet to alter its poles, or both. In other words, one design cannot perform more than a single switching function. Clearly, a similarly simple design which can be used to perform a plurality of switching functions without such alterations would be a marked improvement over the invention of U.S. Pat. No. 5,272,458.

SUMMARY OF THE INVENTION

It is an object of the present invention to provide an improved design which is capable of performing a plurality of switching functions without fundamental alteration.

It is a further objective to provide a design which is highly reliable, simple in construction, relatively inexpensive to manufacture, and is able to operate under the extreme conditions typically found in applications requiring such devices.

An apparatus for switching applications in accordance with a preferred embodiment of the present invention includes one or more coaxially aligned electromagnetic coils separately wound on a common bobbin having a core of ferromagnetic material, a first rare earth permanent magnet within a magnet holder coaxially aligned with the core and located in close proximity to an end of the core, and a second rare earth permanent magnet positioned within the core. The magnet holder with first permanent magnet is constrained to move in a limited direction along the axis of the bobbin core between a first and second position by a channel defined by a magnet holder housing. By aligning the north and south poles of the two permanent magnets in relation to each other and the poles of the electromagnet formed by the electromagnetic coils and core, motion of the magnet holder including the first permanent magnet both toward and away from the bobbin core can be readily induced by applying voltage across the leads of the electromagnetic coils. This motion can be used to move a switching means back and forth between two positions relating to the first and second positions of the magnet holder to perform various failsafe, latching and other useful switching functions.

These and further advantages and structural details will be better understood in view of the detailed description below and the accompanying drawings.

DETAILED DESCRIPTION

Figure 1:
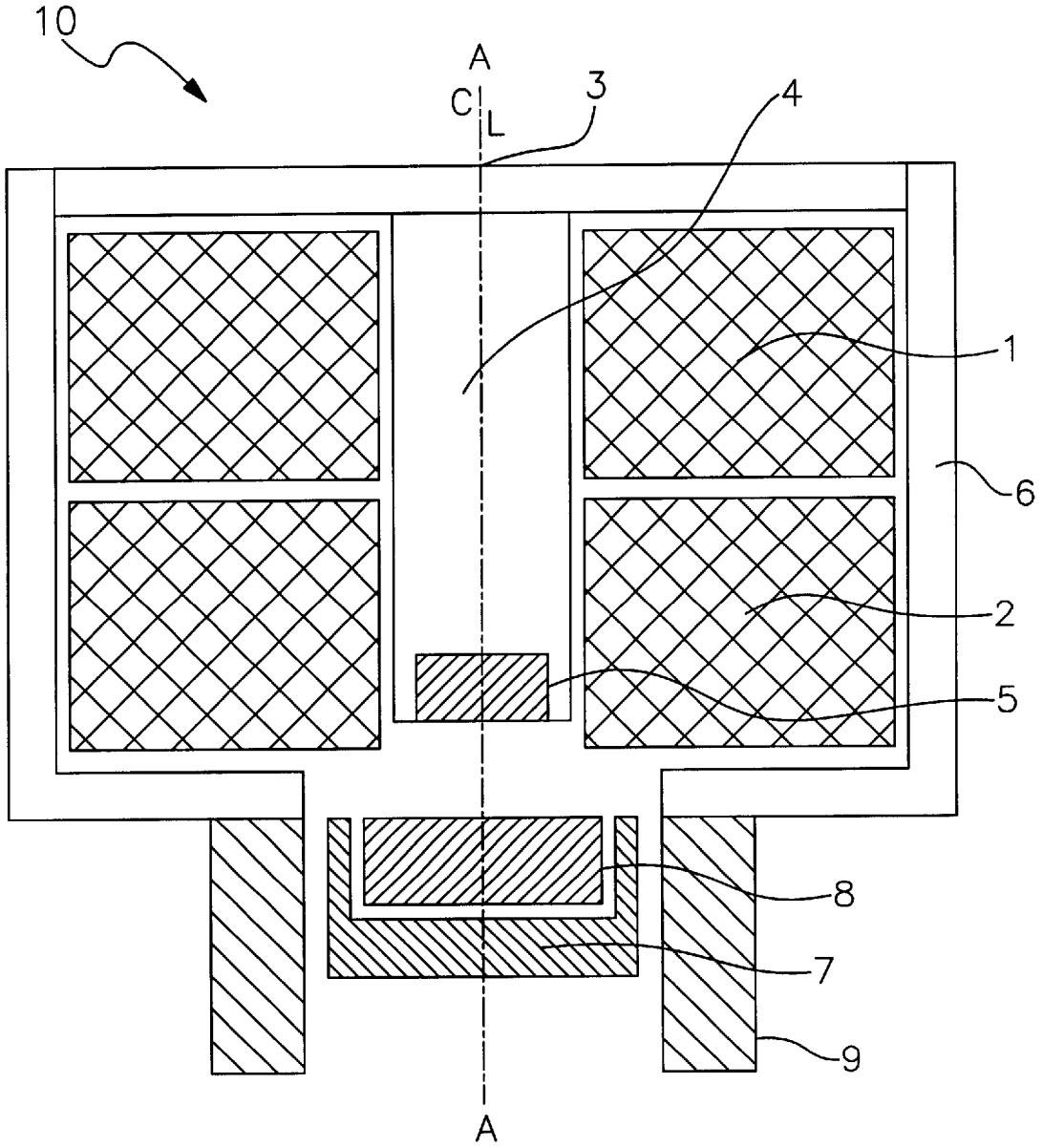
FIG. 1 is a cross-sectional view of a coil set with core and permanent magnet in accordance with one embodiment of the present invention, illustrating the first position of the magnet holder.
Figure 2:
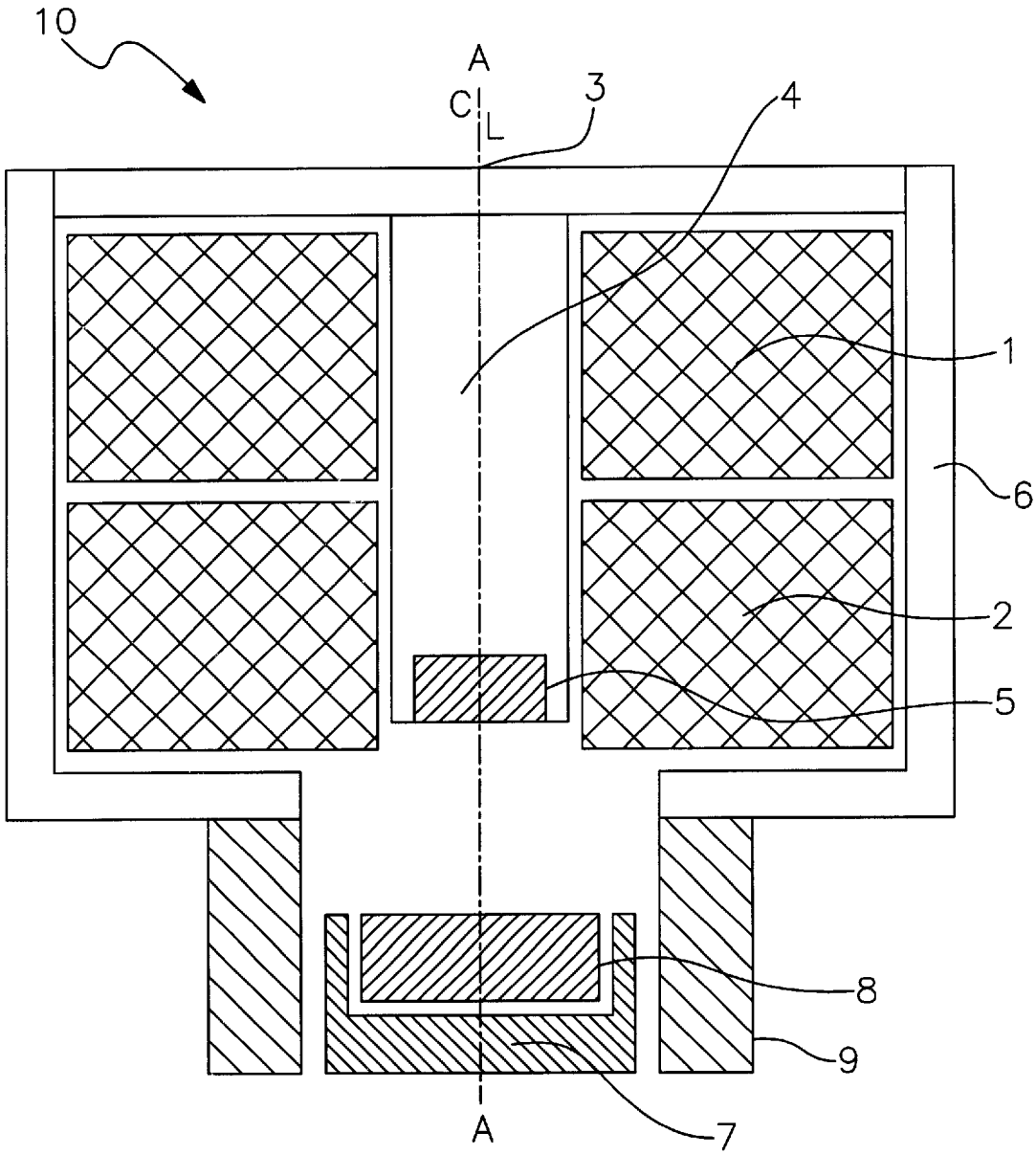
FIG. 2 is a cross-sectional view of the apparatus shown in FIG. 1, illustrating the second position of the magnet holder.

FIGS. 1 and 2 show an apparatus 10 in accordance with a preferred embodiment of the present invention. The apparatus is shown in cross section, being generally symmetrical about a central axis A–A'. The apparatus may be used to actuate any number of switching or similar devices, including DC relays, RF microwave switches and the like.

Apparatus 10 includes an electromagnet comprising wire coils 1 and 2 wound about a generally cylindrical bobbin 3 having a central core 4 made of a ferro-magnetic material. While two wire coils 1 and 2 are shown in the embodiments of FIGS. 1 and 2, it must be understood that several of the many known switching functions require the use of just one wire coil, this being further disclosed in the paragraphs which follow, and that others anticipated but not described herein may require the use of more than two. An optional housing 6 encloses coils 1 and 2, bobbin 3 and core 4, and may be made of any suitable material. A rare earth permanent magnet 5 is immediately adjacent to or contained within the body of core 4. Permanent magnet 5 is located in the preferred embodiment of FIGS. 1 and 2 at the end of core 4 closer to a rare earth permanent magnet 8; however, it must be accepted that this present invention anticipates the positioning of permanent magnet 5 at any location along the length of and within core 4, including either end of core 4. Permanent magnet 5 must be only positioned in such a way so as to magnetize core 4. In one embodiment disclosed further in the paragraphs which follow, permanent magnet 5 is not required to realize the switching function described, and so is omitted.

Apparatus 10 further comprises a magnet holder 7 containing rare earth permanent magnet 8, being constrained to move along central axis A–A' between a first position shown in FIG. 1, and a second position shown in FIG. 2, within a channel defined by magnet holder housing 9. Magnet holder housing 9 may be made of any suitable material, and is positioned off one end of core 4, with its axis coincident with central axis A–A'. Magnet holder 7 and magnet holder housing 9 are so formed to allow free and nearly-frictionless motion of magnet holder 7 within the channel defined by magnet holder housing 9.

In the preferred embodiment, all parts comprising apparatus 10 are generally cylindrical in shape or circular in horizontal cross-section, with their axes coaxially aligned with axis A–A'; however, it must be understood that this present invention anticipates other shapes or cross-sections which may provide the same or similar functionality as the embodiment described herein.

In order to actuate any number of switching or similar devices, a means to transfer the motion of the magnet holder 7 along central axis A–A' to such devices (not shown) is employed. Such means is not included in the present invention, is common in the art, and is not further described.

Operation of the present invention to realize various latching and momentary failsafe movements is accomplished by the proper placement of the poles of permanent magnets 5 and 8 in relation to each other and to the magnetic fields created when coils 1 or 2 are energized by electrical current.

In one embodiment of the present invention, a momentary failsafe movement in which the magnet holder 7 returns to its first position, shown in FIG. 1, when coils 1 or 2 are no longer energized can be realized by placement of the poles of permanent magnets 5 and 8 in such a way that they are attracted to each other, and by energizing either or both coils 1 and 2 to create a electromagnetic field which overcomes the field of permanent magnet 5, and opposes the field of permanent magnet 8. When either or both coils 1 and 2 are energized, magnet holder 7 containing permanent magnet 8 is repelled and driven by opposing magnetic force to its second position, shown in FIG. 2. When energy is removed from both coils 1 and 2, the electromagnetic field collapses, and mutual magnetic attraction between permanent magnets 5 and 8 draws magnet holder 7 containing permanent magnet 8 back to its first position, shown in FIG. 1. It should be understood that only one of two coils is necessary to realize this movement, and that the second coil, therefore, is redundant or optional, and may be omitted.

In another embodiment of the present invention, a momentary failsafe movement in which the magnet holder 7 returns to its second position, shown in FIG. 2, when coils 1 or 2 are no longer energized can be realized by placement of the poles of permanent magnets 5 and 8 in such a way that they are repelled by each other, and by energizing either or both coils 1 and 2 to create a electromagnetic field which overcomes the field of permanent magnet 5, and attracts permanent magnet 8. When either or both coils 1 and 2 are energized, magnet holder 7 containing permanent magnet 8 is attracted and drawn by magnetic force to its first position, shown in FIG. 1. When energy is removed from both coils 1 and 2, the electromagnetic field collapses, and mutual magnetic repulsion between permanent magnets 5 and 8 drives magnet holder 7 containing permanent magnet 8 back to its second position, shown in FIG. 2. It should again be understood that only one of two coils is necessary to realize this movement, and that the second coil, therefore, is redundant or optional, and may be omitted. It should be further noted that the invention of U.S. Pat. No. 5,272,458 is incapable of the movement described in this embodiment.

Figure 3:
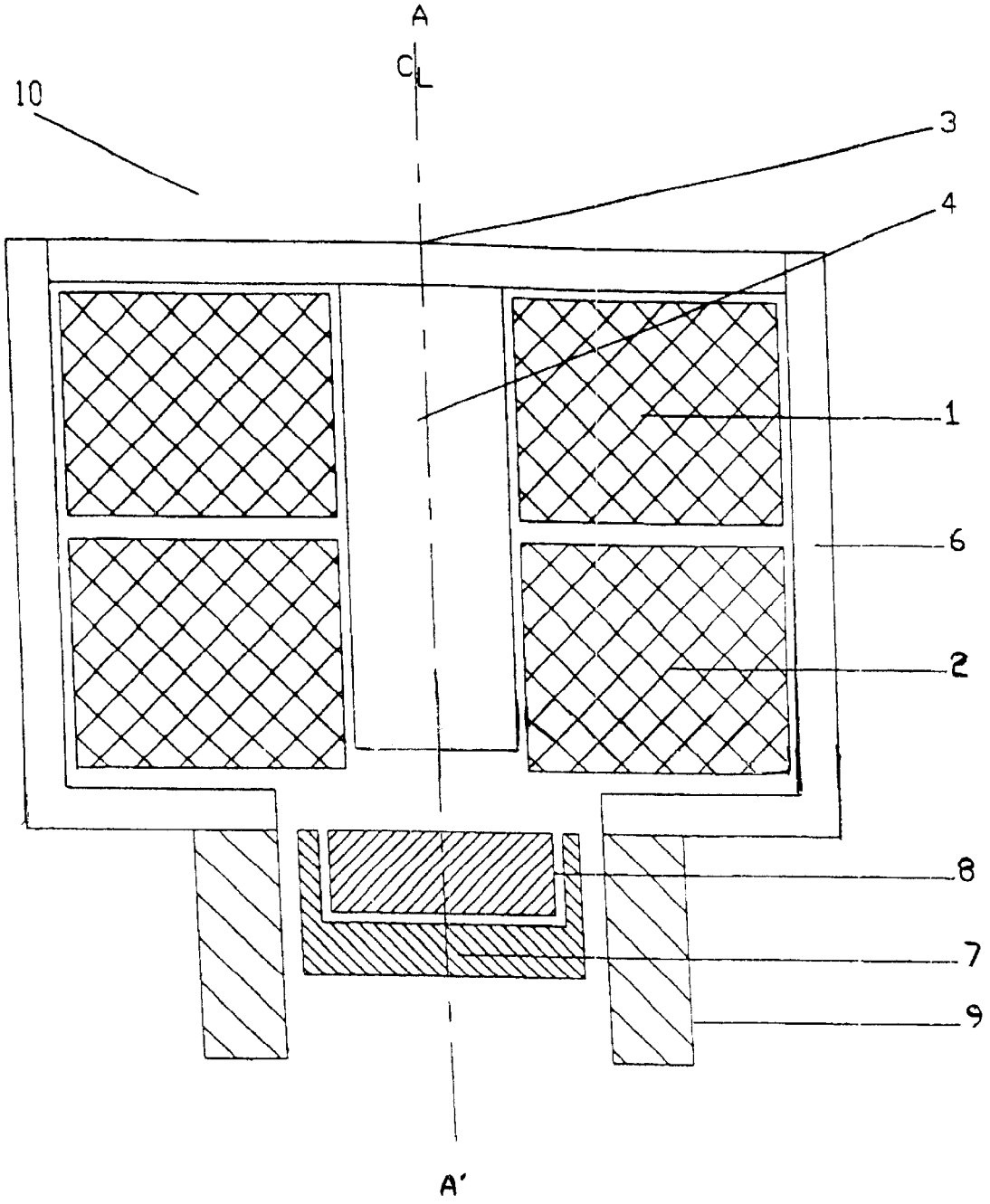
FIG. 3 is a cross-sectional view of a coil set with a core in accordance with an alternative embodiment of the present invention, illustrating the first position of the magnet holder.
Figure 4:
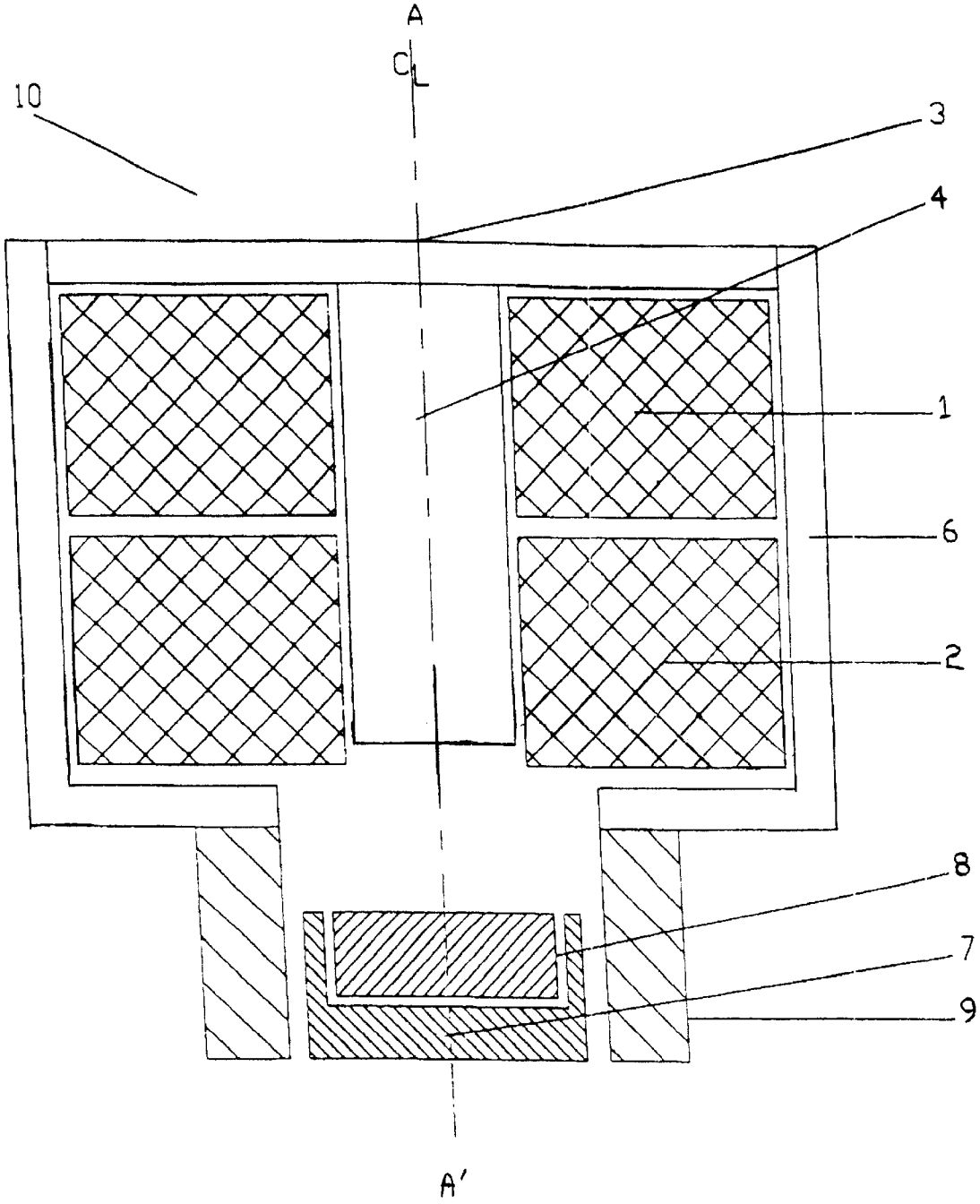
FIG. 4 is a cross-sectional view of the apparatus shown in FIG. 3, illustrating the second position of the magnet holder.

In yet another embodiment of the present invention, as shown in FIGS. 3 and 4, a latching movement in which the magnet holder 7 rests in either its first or second position when coils 1 or 2 are no longer energized can be realized by removing permanent magnet 5 from the apparatus, and by alternatively, momentarily and selectively energizing coils 1 and 2 to create electromagnetic fields which are opposite one another. Where the electromagnetic field created in core 4 by coil 1 attracts permanent magnet 8, magnet holder 7 containing permanent magnet 8 will be drawn to rest in the first position shown in FIG. 3. Where the electromagnetic field created by coil 1 repels permanent magnet 8, magnet holder 7 containing permanent magnet 8 will be repelled and driven to rest in the second position shown in FIG. 4. The same movements can be caused by electromagnetic fields created in core 4 by coil 2. It is apparent, then if coils 1 and 2 create electromagnetic fields of opposing polarity in core 4, there electromagnetic fields, applied only momentarily, will give rise to movement of the magnet holder 7 containing permanent magnet 8 between the first and second positions shown in FIGS. 3 and 4, respectively, thereby realizing a latching function.

The range of motion of magnet holder 7 between positions 1 and 2, shown in FIGS. 1 and 2, respectively, along axis A–A'is necessarily limited by the need for attracting and/or opposing magnetic and electromagnetic fields to effectively interact to cause reliable and repeatable movement, and practically limited by the switching means actuated by this movement, as well as the channel defined by magnet holder housing 9. Accordingly, the present invention can be joined in such a way to a switching means so as to be, at the same time, self-limiting and self-adjusting, characteristics both known and highly desired in this industry.

It should be further noted and appreciated from the above that the present invention has only one moving part, the magnet holder 7, apart from a switching means being actuated. As a consequence, reliability of the present invention is greatly increased. Furthermore, ease of manufacturing with a corresponding reduction in costs is assured by a single, simple design. Still further, because of the low inherent mass of the single moving part, the magnet holder 7, it is believed that the present invention is capable of switching between positions 1 and 2, shown in FIGS. 1 and 2 respectively, at higher speeds than most present or prior actuators. Yet further, the simple design of the present invention is highly resistant to degradation caused by the environmental extremes of mechanical shock, vibration, acceleration, temperature and humidity.

It should also be understood that numerous modifications of the present invention, in its various aspects, will be readily apparent to those skilled in the art, some being apparent only after study and others being matters of usual electromechanical design. Several such areas where modifications are immediately apparent have been detailed in the description above. As such, the scope of the present invention should not be limited to the particular embodiments described above, but should be defined instead by the appended claims and equivalents thereof.

I claim:

1. An apparatus for switching DC relays, RF microwave switches and other switching applications comprising:

a housing;

an electromagnet mounted in the housing, the electromagnet having a core of ferromagnetic material surrounded by a bobbin, the core having a first end and a second end;

a first and a second coil wound on the bobbin, the first coil located at the first end of the core and the second coil located at the second end of the core;

a magnet holder housing mounted adjacent the second end of the core, the magnet holder housing having a channel therein;

a magnet holder located in the channel, the magnet holder movable between a first position and a second position within the channel;

a first permanent magnet mounted in the magnet holder; and the electromagnet being adapted to attract the first permanent magnet and the magnet holder to the first position when the first coil of the electromagnet is momentarily energized, the electromagnet being adapted to repel the first permanent magnet and the magnet holder to the second position when the second coil of the electromagnet is momentarily energized.

* * * * *